US006314968B1

(12) United States Patent
Navarro

(10) Patent No.: US 6,314,968 B1
(45) Date of Patent: Nov. 13, 2001

(54) HAIR-CURLER AND METHOD FOR SETTING HAIR

(75) Inventor: Rose-Marie Navarro, Aigues-Mortes (FR)

(73) Assignee: J.N.D., Paris (FR)

( * ) Notice: Subject to any disclaimer, the term of this patent is extended or adjusted under 35 U.S.C. 154(b) by 0 days.

(21) Appl. No.: 09/308,336

(22) PCT Filed: Nov. 14, 1997

(86) PCT No.: PCT/FR97/02050

§ 371 Date: Jul. 20, 1999

§ 102(e) Date: Jul. 20, 1999

(87) PCT Pub. No.: WO98/21997

PCT Pub. Date: May 28, 1998

(30) Foreign Application Priority Data

Nov. 18, 1996 (FR) ..... 96/14251

(51) Int. Cl.[7] ..... A45D 2/14; A45D 2/12; A45D 7/00

(52) U.S. Cl. ..... 132/248; 132/226; 132/210

(58) Field of Search ..... 132/248, 226, 132/210, 211, 245, 251, 250, 261, 237

(56) References Cited

U.S. PATENT DOCUMENTS

| | | | | |
|---|---|---|---|---|
| 2,652,840 | * | 9/1953 | Isaacs et al. | 132/248 |
| 2,796,872 | | 6/1957 | Mussy . | |
| 2,896,638 | * | 7/1959 | Korsmo | 132/248 |
| 3,395,790 | * | 8/1968 | Smith | 132/248 |
| 3,530,863 | * | 9/1970 | Foster | 132/248 |
| 3,802,443 | * | 4/1974 | Morane | 132/248 |
| 4,513,760 | * | 4/1985 | Tihonovich | 132/248 |
| 4,699,160 | * | 10/1987 | Wiggin | 132/248 |
| 4,732,169 | * | 3/1988 | Van Sickle | 132/248 |
| 5,316,021 | * | 5/1994 | Giordano | 132/248 |
| 5,487,396 | * | 1/1996 | Wilson | 132/248 |
| 5,551,457 | * | 9/1996 | Williamson | 132/250 |
| 5,819,760 | * | 10/1998 | Wimer | 132/207 |
| 5,979,465 | * | 11/1999 | Marrese et al. | 132/248 |

FOREIGN PATENT DOCUMENTS

| | | |
|---|---|---|
| 556183C | 7/1932 | (DE) . |
| 967243C | 10/1957 | (DE) . |
| 1557287A | 3/1970 | (DE) . |
| 8125946 U | 11/1981 | (DE) . |
| 0034770A | 9/1981 | (EP) . |
| 2024691A | 8/1970 | (FR) . |
| 2450080A | 9/1980 | (FR) . |

* cited by examiner

*Primary Examiner*—John J. Wilson
*Assistant Examiner*—Robyn Kieu Doan
(74) *Attorney, Agent, or Firm*—Stevens, Davis, Miller & Mosher, LLP

(57) ABSTRACT

The invention concerns a non-heating hair-curler comprising at least over 50% of its usable length one single tapered body (1) with an end of small diameter and an end of large diameter, said tapered body (1) being extended to one of its end by a cylindrical or almost cylindrical body (2, 3) of substantially the same diameter. The invention also concerns a method for hair setting.

13 Claims, 1 Drawing Sheet

HAIR-CURLER AND METHOD FOR SETTING HAIR

The present invention concerns a hair-curler and a method of setting hair. It can be used to perm and set hair.

Ordinary hair-curlers generally comprise a body that is cylindrical or slightly thinner toward the middle of its length. They can be made of any suitable material, such as plastics material and/or metal.

With hair-curlers having a body that is cylindrical or thinner in the middle, flat and horizontal strands of hair with a width corresponding to that of the hair-curler are taken up from the hair roots. The hair is then rolled from the tips toward the roots in concentric layers that are more or less numerous and thick. At the end of this rolling, the hair-curler is tangential to the scalp, where it is held in place.

In cold perming, the treatment products, if applied after rolling, penetrate and impregnate in a more or less regular manner the layers rolled on first, i.e. the deepest ones. The same problems are encountered on the first rinsing with water and on applying the fixative that constitutes the final phase of treating the hair before removing the hair-curlers.

The results obtained are sometimes disappointing, with soft and short-lived curliness. The hair has an irregular wavy appearance. Another problem, observed at the tips of the strand, is a loss of curliness in the order of 30% of the diameter of the hair-curler. This mediocre result, usually called "straight tips", must be corrected using a curling iron if a more refined result is to be obtained.

To reduce the above drawbacks, very fine strands are curled, and in the case of long hair several hair-curlers with different diameters are used for the same strand of hair. This procedure, known as "double or triple rolling", is more difficult to execute.

Starting from the middle of the strand of hair, the hair is rolled on in the required direction as far as the hair roots, where the hair-curler is held tangentially to the scalp by an elastic band stretched between its two ends or by a pin passed through the rolled hair and the body of the hair-curler. The hair of the remainder of the strand of hair is rolled onto a different diameter hair-curler, starting from the tips and in the opposite direction, until the two hair-curlers are juxtaposed. The hair-curler is held in place by one of the means mentioned above. This technique requires great professional skill.

The above two procedures increase the number of hair-curlers required for a perm, take a longer time to execute and are uncomfortable for the client.

If cut transversely with scissors, a strand of hair formed with hair-curlers of the above design has a flat section due to rolling in concentric layers.

Hair-curlers with a frustoconical body, as described in FR-A-1.007.774 and EP-A-0.283.305 have two major drawbacks because of their exclusively and very marked frustoconical shape: first of all, it is very difficult to hold the tips of the strand of hair to begin rolling it on, and then the strand of hair slips toward one or other end of the hair-curler, either when rolling it on or during treatment. Hair-curlers of exclusively frustoconical shape have not retained the interest of hairdressing professionals.

Regardless of the shape of the hair-curlers, the methods of fixing them (pins, clips or elastic bands) have advantages and drawbacks that are often mutually opposed.

For the method of fixing the hair-curler by means of an elastic band stretched between its two ends, elastic bands of different lengths have been produced with one or more holes at one end to adapt the tool as well as possible to the particular requirements of each perm. Nevertheless, depending on the length of the hair-curler and the volume of hair rolled onto it, the elastic band that should hold the hair-curler in the required position is often not taut enough or too taut and leaves an imprint on the hair.

Although it is easy to hook an elastic band onto a hemispherical or lens-shaped end when holding a hair-curler in the hand, it is much more difficult on a hair-curler that has already been fitted. There is a tendency to lift up the hair-curler, to make it easier to hook on the elastic band, so causing uncomfortable pulling of the hair which is sometimes painful for the client. There is also a tendency to employ the easy way out of placing the elastic band in front of one and moving it to the required position near the hair roots by causing it to slide with the fingers. This additional gesture, which is slow to execute, is also uncomfortable for the client.

The present invention concerns a hair-curler enabling faster and easier perming and setting of the hair, giving the hair a natural appearance with well-formed curls.

This is achieved in accordance with the invention by a non-heated hair-curler characterized in that it comprises:

over at least 50% of its usable length a single frustoconical body having a small diameter end and a large diameter end, said frustoconical body being extended at one end by a cylindrical or quasi-cylindrical body of substantially the same diameter.

To facilitate the description, the expression "cylindrical body" will be used to refer to the cylindrical or quasi-cylindrical bodies of the invention. If "a single body of frustoconical shape" is referred to, it is obvious to the skilled person that a plurality of successive frustoconical bodies with a slope decreasing fairly regularly and possibly spaced by short plateaux 1 to 3 mm long, for example, should be considered as a single body of frustoconical shape since they in fact have the same function.

If the hair-curler of the invention has a cylindrical body at only one end, either the small diameter end or the large diameter end, the length of said cylindrical body preferably represents 18 to 40% of the usable length of the hair-curler, i.e. the cylindrical body/frustoconical body combination, and preferably 20 to 30% thereof.

The hair-curler of the invention is preferably characterized in that its second end is extended by a cylindrical or quasi-cylindrical body of substantially the same diameter as said second end.

In this case, the length of the two cylindrical bodies preferably represents 30 to 50% of the usable length of the hair-curler and for example 35 to 45% thereof.

If two cylindrical bodies are used, they can have different lengths. However, they are preferably of substantially identical length and advantageously each of them represents 40 to 60% of the sum of their two lengths.

A "solid" hair-curler in accordance with the invention is suitable for perming. To improve its performance, for example in the case of cold perming, a hair-curler of the invention is preferably characterized in that it is hollow in the manner of a pipe to form a tunnel and comprises multiple openings through which its interior volume communicates with the exterior, to enable a liquid to wet hair situated against the hair-curler by passing through its interior.

Such communication can be obtained by many means well known to the skilled person, for example a plurality of circular orifices or elongate slots.

The communicating area can represent 10% or more, preferably 20% or more, and for example 30% or more of the surface area of the hair-curler. It will be obvious to the skilled person that the greater the area of communication on the surface of the hair-curler, the better will hair inside a rolled strand of hair be impregnated. A limit is obviously set by the strength or stiffness of the hair-curler. There must remain sufficient material constituting the hair-curler for it to retain its shape and dimensions.

Such communication is preferably provided by slots, preferably slots in the frustoconical body, for example in the frustoconical body and the cylindrical body or bodies.

In these extreme cases of implementation of the invention, and depending on the material(s) used, the material at the surface of the hair-curler has a smaller area than the area of communication.

To prevent hair sliding out of the hair-curler, a preferred hair-curler in accordance with the invention is characterized in that at least one cylindrical or quasi-cylindrical body is provided at the end of the hair-curler with a protuberance or a plurality of protuberances to prevent the hair slipping out of the hair-curler.

There can be a single protuberance, for example an annulus, a disk or a ring of greater diameter than the cylindrical body at whose end it is disposed. There can equally well be a plurality of protruding spikes, for example.

Said cylindrical or quasi-cylindrical body is preferably provided with a protuberance which constitutes a flange, as shown in the drawings. In this case, the protuberance has a plurality of functions.

The first of these has been mentioned already, and consists in preventing the hair from slipping out of the hair-curler. The other functions are mentioned hereinafter.

The hair-curler of the invention is preferably characterized in that it has a fixed or fixable clip at one end.

This clip, which is for immobilizing the hair on the hair-curler, by extending from one end to the other thereof, can be fixed by means of many devices that are well known in the art.

The clip is preferably removable so that it can be replaced if required. This is the case if it is a clip with elastic properties, for example, with the possibility of the elastic properties being lost through aging.

A preferred fixing device is a nipple on one end of the hair-curler of the invention and cooperating with an opening in the clip, for example, as shown in the figures.

Another preferred fixing device comprises an opening, preferably an axial opening, at one end of the hair-curler. This can cooperate with a clip, preferably an elastic clip, provided at one end of a voluminous member larger than the aforementioned tunnel. In this way it is possible, while rolling the hair, to leave the clip inside the central tunnel of a hollow hair-curler in accordance with the invention and to extract it to fasten it by pulling on the other end, the voluminous extremity being immobilized when it comes into contact with the entry of the opening. For example, if the clip is elastic, a ball can be provided at one end to serve as the voluminous member and which can be forced into the hair-curler when it is fitted. The elastic band is held effectively because the elastic band must be U-shaped so that it can be immobilized at the other end of the hair-curler, even if the diameter of the ball is not considerably greater than the section of the tunnel. The opening can also be U-shaped, with parallel branches, to enable the clip to be inserted therein by sliding it in the direction of the axis of the hair-curler. The U-shaped opening is then preferably narrower than the section of the clip, widening toward the bottom of the U. The variant with an opening at one end of the hair-curler has the advantage of minimizing the length and the weight of a hair-curler in accordance with the invention.

In other preferred embodiments of the invention the clip is elastic and the device for fixing the clip is one side of at least one cut-out in the flange with dimensions adapted to immobilize the clip when the latter is inserted into the cut-out.

There can be one cut-out, but preferably a plurality of cut-outs are used, for example 4 to 10 cut-outs, and they are preferably regularly spaced around the protuberance. To improve the immobilization of the clip, they are preferably not situated in pairs on a common diameter. A plurality of protruding spikes can also be used to immobilize the clip, either because the spaces between them constitute cut-outs, as it were, or because immobilization is based on the principle of the nipple referred to above.

If it is possible to immobilize the clip using cut-outs in two flanges at respective opposite ends of the hair-curler of the invention, for example, there is preferably a nipple at one end and a flange with at least one cut-out as mentioned above at the other end, given that preferably only one end needs to be adjustable.

The presence of a nipple at one end does not rule out the presence of a flange at the same end. To the contrary, there is preferably a flange at each end. A second function of the flange(s) is to prevent the clip pressing too heavily on the hair when fitted, in particular when it is an elastic clip. This is why the flange(s) can protrude relative to the surface of the cylindrical bodies by an amount in the range from 1 to 4 mm, for example, preferably from 1.5 to 2.5 mm.

A hair-curler in accordance with the invention obviously has dimensions suited to its use. The cylindrical or quasi-cylindrical body or bodies preferably each have a length less than or equal to 30 mm, for example 20 mm, when the frustoconical body has a length of 40 mm or greater, for example 50 mm or greater. A preferred hair-curler in accordance with the invention advantageously has a usable length of 60 to 150 mm, preferably 60 to 120 mm, for example 60 to 100 mm.

The cone angle (between one side of the hair-curler and the axis) is preferably less than 10° and can be in the range from 2° to 6°, for example from 2.5° to 4°.

The hair-curler of the invention can be used as follows, depending on existing styles or the requirements of clients:

In a first embodiment, starting by rolling strands of hair onto the straight part of the hair-curler, tightly curled strands of hair are obtained at the tips of this hair, progressively widening to give an undulating effect at the roots.

In a second embodiment, starting by rolling strands of hair onto the wide part of the hair-curler, more voluminous, flexible and light curls are obtained at the tips of the hair, progressively tightening to give more volume than previously near the scalp, an effect usually called lifting at the roots by hair care professionals, together with well-formed waves offering greater resistance to stretching caused by the weight of the strand of hair.

In both cases strands of hair of greater volume than in the method presently used and having a close to square surface at the base can be used at the roots of the hair.

The tip end of the strand of hair can be immobilized first by rolling approximately one and a half turns onto the cylindrical body or one of the cylindrical bodies of the hair-curler, after which the hair is rolled helically, avoiding superposition of turns, with rolling finishing at the root of the hair at the other end, for example on the other cylindrical body of the hair-curler if a hair-curler with two cylindrical bodies is used. At the end of rolling, the hair-curler is vertical in the fashion of a ringlet, and is preferably held in this position by an elastic band stretched between its two ends.

Strands of hair 60 cm long or longer can be treated in a single rolling using hair-curlers 15 or even 20 cm long.

It should be noted that a hair-curler in accordance with the invention can also be used for permanent waving or setting using the so-called double rolling technique.

Very long strands of hair are treated using two hair-curlers in accordance with the invention of different size with the larger diameter of one corresponding to the smaller diameter of the other.

For example, rolling of the hair starts from the middle of the strand of hair, at the smaller diameter end of the larger hair-curler and finishes at the roots of the hair, at the larger diameter end. The remaining part of the strand of hair is treated by starting from the tips of the hair using the small diameter end of the smaller hair-curler and rolling the hair in the opposite direction to finish at the larger diameter end just below the hair-curler applied first. The diameters of each hair-curler then match up.

After removing the hair-curlers and drying with a hair-drier, there is no sign of interruption of curliness in the strands of hair.

In using the hair-curler of the invention, the manner of rolling the hair is exactly the same and, during rolling, the strands of hair continue to have a round section. If cut transversely with scissors, a strand of hair treated in this way has a cylindrical section.

To hold the hair-curler of the invention in place using an elastic clip, the clip is stretched after fixing it at one end, for example by means of a nipple. It is then immobilized at the other end, for example by means of another nipple. To this end, the elastic band can be a flat elastic band with a plurality of orifices that are preferably rounded and regularly spaced.

It is also possible to use a round section elastic band having a flattened portion at one end with an orifice in it into which a nipple at the other end of the hair-curler is inserted. The other and of the hair-curler is then preferably provided with a flange with a plurality of slots, notches, cut-outs or the like. The stretched elastic band is inserted into a cut-out; letting go immobilizes the elastic clip in the cut-out.

Multiple notches around the circumference of the protruding flange at one or both ends of the hair-curler enable, in a single gesture: a) using only the strictly necessary length of elastic band, b) obtaining the adequate tension to hold the hair-curler in place and in the required position, and c) placing the elastic band as close as possible to the roots of the hair without this being uncomfortable for the client.

In accordance with the invention, hair rolled helically, without superposition and with the same thickness, is easily impregnated by the various treatment and rinsing liquids.

Further in accordance with the invention, the result obtained is a perm with well-formed, flexible curls that are durable and easy for the client to return to shape after washing the hair. The invention reduces the time to execute a perm on hair of average length by around 40% by reducing the number of hair-curlers to be fitted and because of the ease with which they can be held in place.

The invention also represents a saving in terms of the quantity of treatment products, made possible by easier application, effective penetration and action and faster rinsing.

A final object of the present application is a method of styling hair characterized in that it comprises an operation of rolling hair around a hair-curler as defined hereinabove, starting with rolling a strand of hair onto the cylindrical or quasi-cylindrical body, or one such body, so that the longer hairs of the strand are at the larger diameter end of the frustoconical body.

The drawings illustrate the invention:

The dimensions given hereinafter are for one example of a hair-curler with a usable length of 85 mm.

Figure 1:
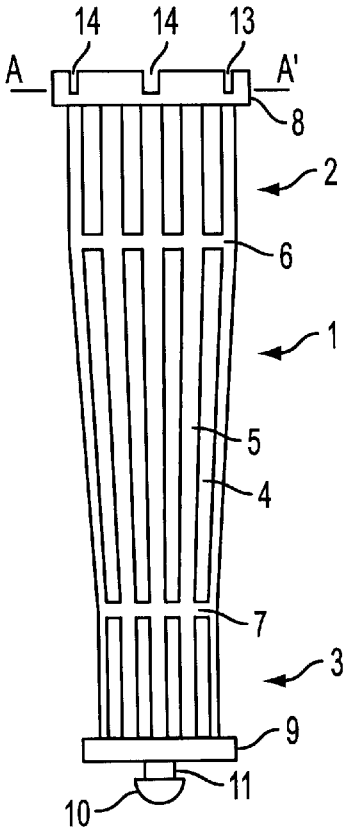
FIG. 1 is an elevation view of a hair-curler of the invention.
Figure 2:
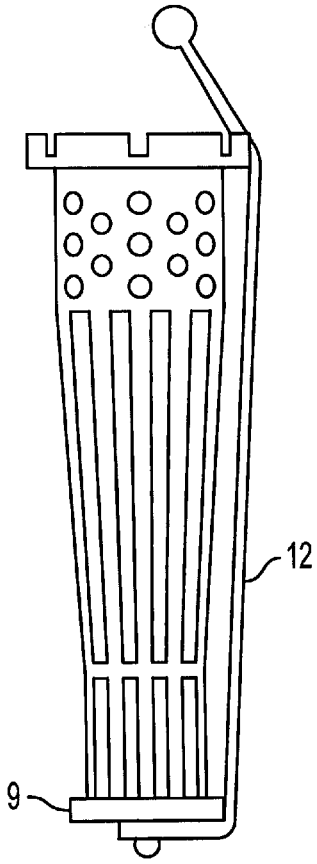
FIG. 2 is an elevation view of a hair-curler of the invention fitted with a clip.

Referring to FIG. 1, the greater part of the usable length of the hair-curler comprises a frustoconical hollow body 1 which is 50 mm long extended at each end by a shorter body 2, 3 which is 20 and 15 mm long and of hollow cylindrical shape, with diameters of 20 and 15 mm. It has slots 4 through which the inside and outside of the hair-curler communicate with each other. The slots 4 leave two rings 6, 7 at the junction of the frustoconical part 1 and the cylindrical parts 2 and 3, to improve the overall stiffness (and with the ancillary effect of showing more clearly in the drawing the three main parts of the hair-curler of the invention). As mentioned above, the slots can be replaced with other types of orifice, such as circular holes as shown in FIG. 2, or a square mesh. They can also be provided in the form of a net fitted to a metal or plastics material frame. The exposed surface of the strips of material 5 between the slots 4 is textured or striated, this roughness limiting slipping of the hair during rolling.

The hair-curler shown here has an annular flange 8 which is 5 mm wide at one end and an annular flange 9 which is 3 mm wide at the other end, the flanges projecting about 2 mm from the surface of the cylindrical parts 2 and 3 because their diameter is greater than that of said cylindrical bodies. The flanges 8 and 9 have three functions: a) holding the strand of hair in the required space, b) preventing the strand of hair slipping out of the hair-curler, and c) preventing or limiting pressure on the hair if the hair-curler is held in place by an elastic band stretched between its two ends.

The hair-curler also has at one end a nipple 11 extended by a hemispherical body 10 of greater diameter than the nipple.

The hair-curler shown here has notches or cut-outs 13, 14 at the other end on the perimeter of the flange 8 to immobilize an elastic band 12, as shown in FIG. 2, for fixing the hair-curler in the required position and to maintain it at the required tension.

As mentioned above, the flange 9, the nipple 11 and the hemispherical body 10 can be replaced by a flange of the same type as the flange 8, if required. The variant with two flanges 8 is not shown.

FIG. 2 shows the same component parts as FIG. 1 and additionally an elastic band 12 fitted between a nipple 11, which is hidden by the elastic band 12, and one of the notches 13, 14. The slots in the cylindrical body 2 have been replaced in part by circular orifices. The hemispherical body 10 has been replaced by a smaller quasi-spherical body.

Figure 3:
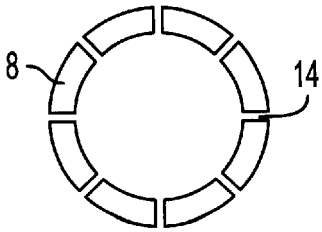
FIG. 3 is a sectional view taken along the line AA' in FIG. 1.

FIG. 3 is a sectional view of a hair-curler in accordance with the invention taken along the line AA' in FIG. 1 and shows the notches 14 around the perimeter of the flange 8. To immobilize the circular section elastic band 12 used to immobilize the hair-curlers, their width is less than the diameter of the elastic band. It is possible to use one notch 14 or two opposite notches 14 for this purpose. Note also the hollow configuration of the hair-curler. If a nipple 11 is used, this can be on a bridge formed diametrally on a flange 9, for example.

What is claimed is:

1. A non-heated hair-curler having an exterior surface, a first end and a second end, said hair-curler comprising:

a single, hollow frustoconical body (i) extending over at least 50% of a usable length of said hair-curler and defining an interior volume, and (ii) said first end having a first diameter and said second end having a second diameter, said first diameter being smaller than said second diameter;

said frustoconical body having at least two openings through which said interior volume communicates with said exterior surface to enable liquid to wet hair that contacts said hair-curler by passing through said at least two openings from said interior volume to said exterior surface; and a cylindrical or quasi-cylindrical body attached to and extending at least one of said first and second ends and having substantially a same diameter as said at least one of said first and second ends.

2. A non-heated hair-curler according to claim 1, wherein at least one cylindrical or quasi-cylindrical body is provided with a protuberance or a plurality of protuberances at the end of the hair-curler to prevent the hair slipping out of the hair-curler.

3. A non-heated hair-curler according to claim 2 wherein said cylindrical or quasi-cylindrical body is provided with a protuberance which is in the form of a flange.

4. A non-heated hair-curler according to claim 1 which has a fixed or fixable clip at one end.

5. A non-heated hair-curler according to claim 3 wherein said flange is provided with at least one system for fixing a clip.

6. A non-heated hair-curler according to claim 5 wherein said clip is elastic and said system for fixing said clip at one end comprises at least one cut-out in said flange with dimensions adapted to immobilize said clip when the latter is inserted into said cut-out.

7. A non-heated hair-curler according to claim 1 wherein said at least one cylindrical or quasi-cylindrical body has a length of at most 20 mm and said frustoconical body has a length of at least 40 mm.

8. A method of setting hair, which comprises an operation of rolling hair around a hair-curler according to claim 1, beginning with rolling an end of a strand of hair onto said frustoconical body so that longer hairs of the strand of hair are at the second end of said frustoconical body.

9. The method of claim 8, further comprising the steps of:

immobilizing the strand by initially rolling approximately one and a half overlapping turns onto said cylindrical body attached to one of said first and second ends;

thereafter helically rolling the strand of hair onto said frustoconical body while avoiding superposition of turns;

finishing rolling the strand of hair at the root of the strand of hair and at the other of said first and second ends so that said hair-curler is vertical in the fashion of a ringlet; and holding said rolled hair-curler in a vertical position with a removable clip placed so as to extend between said first and second ends.

10. The method of claim 9 wherein said removable clip is an elastic band stretched between said first and second ends and removably fixed to at least one of said first and second ends.

11. A method of setting hair, which comprises an operation of rolling hair around a hair-curler which comprises at least a frustoconical body having a pair of ends, said method comprising the steps of:

immobilizing the strand by initially rolling approximately one and a half overlapping turns around said frustoconical body starting at one of said first and second ends;

thereafter helically rolling the strand of hair around said frustoconical body while avoiding superposition of turns;

finishing rolling at the root of the strand of hair at the other of said first and second ends so that said hair-curler is vertical in the fashion of a ringlet; and holding said rolled hair-curler in a vertical position with a removable clip placed so as to extend between said first and second ends.

12. The method of claim 11 wherein said removable clip is an elastic band stretched between said first and second ends and removably fixed to at least one of said first and second ends.

13. A kit for curling very long hair comprising:

two frustoconical curlers according to claim 1, wherein the second end having said larger diameter of one of said curlers is equal to the first end having said smaller diameter of the other of said curlers.

* * * * *